United States Patent [19]

Arrington

[11] Patent Number: 5,015,298

[45] Date of Patent: May 14, 1991

[54] COMPOSITION AND METHOD FOR REMOVING IRON CONTAINING DEPOSITS FROM EQUIPMENT CONSTRUCTED OF DISSIMILAR METALS

[75] Inventor: Stephen T. Arrington, Duncan, Okla.

[73] Assignee: Halliburton Company, Duncan, Okla.

[21] Appl. No.: 557,557

[22] Filed: Jul. 24, 1990

Related U.S. Application Data

[63] Continuation of Ser. No. 399,377, Aug. 22, 1989, abandoned, which is a continuation of Ser. No. 148,840, Jan. 27, 1988, abandoned.

[51] Int. Cl.[5] ..... C23G 1/06

[52] U.S. Cl. ..... 134/2; 134/3; 134/28; 134/41

[58] Field of Search ..... 134/2, 3, 28, 41; 252/82, 87

[56] References Cited

U.S. PATENT DOCUMENTS

| | | | |
|---|---|---|---|
| 3,072,502 | 1/1963 | Alfano | 134/3 |
| 3,248,269 | 4/1966 | Bell | 148/6.14 |
| 3,438,811 | 4/1969 | Harriman et al. | 134/2 |
| 3,634,257 | 1/1972 | Porter et al. | 252/87 |
| 3,956,164 | 5/1976 | Walker et al. | 252/180 |
| 4,138,353 | 2/1979 | Lipinski | 252/181 |
| 4,264,418 | 4/1981 | Wood et al. | 204/129.95 |
| 4,351,673 | 9/1982 | Lawson | 134/3 |
| 4,443,268 | 4/1984 | Cook | 134/2 |
| 4,586,961 | 5/1986 | Bradley et al. | 134/2 |
| 4,623,399 | 11/1986 | Frenier | 134/3 |
| 4,636,327 | 1/1987 | Frenier et al. | 252/87 |
| 4,666,528 | 5/1987 | Arrington et al. | 134/2 |
| 4,719,031 | 1/1988 | Coleman | 252/180 |
| 4,721,532 | 1/1988 | Kuhn et al. | 134/3 |
| 4,855,069 | 8/1989 | Schuppiser et al. | 252/87 |

FOREIGN PATENT DOCUMENTS

| | | |
|---|---|---|
| 2461612 | 7/1976 | Fed. Rep. of Germany . |
| 926401 | 5/1963 | United Kingdom . |
| 1203722 | 9/1970 | United Kingdom . |

OTHER PUBLICATIONS

Pg. 91, 103 and 265 from M. Fontana et al., Corrosion Engineering, 2nd Edition.

*Primary Examiner*—Asok Pal
*Attorney, Agent, or Firm*—Robert A. Kent

[57] ABSTRACT

A composition and method for removing iron containing deposits from a metal surface are provided. The metal surface is contacted with an aqueous cleaning composition comprising an acid selected from the group consisting of polycarboxylic acids and polyphosphonic acids, and at least one base selected from the group consisting of alkali metal hydroxides, alkali metal carbonates and alkali metal phosphates. The aqueous cleaning composition can be used to passivate the metal surface after iron containing deposits are removed therefrom. The composition and method are very suitable for removing iron containing deposits from metal surfaces of equipment constructed of dissimilar metals without adversely affecting the metals.

7 Claims, No Drawings

COMPOSITION AND METHOD FOR REMOVING IRON CONTAINING DEPOSITS FROM EQUIPMENT CONSTRUCTED OF DISSIMILAR METALS

This is a continuation of copending application(s) Ser. No. 07/300,377 filed on Aug. 22, 1989, which is a continuation of application Ser. No. 148,840, filed Jan. 27, 1988, now both abandoned.

BACKGROUND OF THE INVENTION

1. Field of the Invention.

The present invention relates generally to chemical cleaning compositions and methods, and more particularly, but not by way of limitation, to compositions and methods for removing iron containing deposits from metal surfaces 2. Description of the Prior Art.

The operation of various equipment such as feed water heaters, steam boilers, equipment associated with service water systems and other equipment in which water is circulated is often hindered by the formation of water insoluble deposits or scale on the interior surfaces thereof. The formation of such deposits can interfere with proper heat transfer, decrease the capacity of the flow passages in the equipment and lead to leaks and ruptures which necessitate undesirable down time and maintenance costs.

Many cleaning methods and solvents have been developed for removing various types of deposits from the interior metal surfaces of equipment. Typical solvents include acids such as hydrochloric acid and nitric acid, or ammonia or amine salts of organic chelating acids such as citric acid or ethylenediaminetetraacetic acid (EDTA). The solvents are circulated through the equipment under conditions and for a period of time sufficient to remove the deposits. This allows the deposits to be effectively removed without the expense and time required to dismantle the equipment.

In any cleaning process, it is desirable to effectively remove the deposits without causing corrosion or other damage to the metal surfaces of the equipment being cleaned. In order to save time and to minimize the amount of waste requiring disposal, it is desirable to remove the deposits and passivate the metal surfaces with only one solvent fill.

Severe corrosion and other damage can result to the metal surfaces forming the equipment being cleaned if the wrong solvent is used. For example, nitric acid can cause severe corrosion damage to carbon steels, copper, and copper bearing alloys such as brass and bronze. Chloride ions from hydrochloric acid can cause stress corrosion cracking to occur in stainless steels. Copper and copper bearing alloys such as brass and bronze are subject to failure by stress corrosion cracking when exposed to ammonia or amines. Thus, when prescribing a solvent, the type of metal forming the equipment as well as the type of deposits formed thereon must be carefully considered.

Prescribing a solvent is not difficult if the equipment to be cleaned is constructed of only one type of metal. A great deal of equipment, however, is constructed of many different types of metals. For example, equipment associated with service water systems is commonly constructed of stainless steel, carbon steel, copper, brass, and other alloys. Such equipment often becomes scaled with iron oxides and other deposits having densities of 10,000 g/m$^2$ (929 g/ft.$^2$) or more. It is difficult to prescribe a solvent that will effectively remove these deposits without causing corrosion or other damage to some of the metals forming the equipment. Many service water systems have to be dismantled so that their different metal surfaces can be cleaned separately.

Many of the cleaning methods and solvents developed heretofore are very capable of removing high density iron containing deposits from carbon steels and stainless steels. In U.S. Pat. No. 3,072,502, a process is disclosed in which copper and iron oxide scale is removed from metal surfaces with a chelating solvent containing citric acid. The solvent is adjusted to the required pH by a nitrogen containing base such as triethanolamine or ammonia. In U.S. Pat. No. 3,438,811, a process is disclosed in which copper and copper containing scale is removed from metal surfaces with a chelating solvent containing a polycarboxylic acid, e.g., ethylenediaminetetraacetic acid (EDTA), and/or one or more amine or ammoniated salts thereof. Unfortunately, the solvents used in these processes contain ammonia and/or amines. As a result, they are not suitable for cleaning copper and copper bearing alloys such as brass and bronze.

Prior to the present invention, it was generally accepted by those skilled in the art that a nitrogen containing base such as ammonia or some type of amine must be present in solvents containing chelating acids such as citric acid or ethylenediaminetetraacetic acid (EDTA) for the solvents to effectively dissolve iron. It was thought that ferrous or ferric ammonium salts of the acids were formed when iron containing deposits were dissolved in the solvents. It was believed that the ferrous or ferric ammonium salts of the acids were necessary to prevent precipitation from occurring.

By the present invention, it has been discovered that it is ferrous or ferric salts, not ferrous or ferric ammonium salts, that are formed when iron containing deposits are dissolved in solvents containing chelating acids such as citric acid or ethylenediaminetetraacetic acid (EDTA) and a nitrogen containing base. For example, when iron containing deposits are dissolved by a solvent containing citric acid and ammonia, ferrous citrate, not ferrous ammonium citrate, is formed. Ferrous salts of chelating acids such as citric acid and ethylenediaminetetraacetic acid (EDTA) are more soluble at moderately alkaline pH levels than at acidic pH levels. It is the pH of the solvents, not the presence of a nitrogen base in the solvents, that prevents precipitation from occuring and results in the ability of the solvents to effectively dissolve iron containing deposits.

Inasmuch as an amine or ammonia is not necessary for the solvents to be effective, any base capable of raising the pH to the required level can be used. If bases that do not contain an amine or ammonia are used to raise the pH, solvents containing chelating acids such as citric acid and ethylenediaminetetraacetic acid (EDTA) can be used to remove iron containing deposits from all types of metals, including copper and copper bearing alloys such as brass and bronze. Such solvents can be used to clean equipment constructed of dissimilar metals without causing corrosion or other damage thereto.

SUMMARY OF THE INVENTION

In one aspect, the present invention provides an aqueous cleaning composition for removing iron containing deposits from a metal surface. The aqueous cleaning composition comprises at least one alkali metal salt of an acid selected from the group consisting of polycarboxylic acids and polyphosphonic acids.

In another aspect, the present invention provides a method of removing iron containing deposits from a metal surface. The method comprises contacting the metal surface with an aqueous cleaning composition comprising at least one alkali metal salt of an acid selected from the group consisting of polycarboxylic acids and polyphosphonic acids.

It is, therefore, a principal object of the present invention to provide a composition and method for removing iron containing deposits from equipment constructed of dissimilar metals without adversely affecting the metals.

Numerous other objects, features and advantages of the present invention will be readily apparent to those skilled in the art upon a reading of the following disclosure including the examples provided therewith.

DESCRIPTION OF THE PREFERRED EMBODIMENTS

In accordance with the present invention, a composition and method for removing iron containing deposits from a metal surface are provided. The composition and method are particularly suitable for removing iron containing deposits from metal surfaces of equipment constructed of dissimilar metals.

The composition of the present invention can broadly be described as an aqueous cleaning composition comprising at least one alkali metal salt of an acid selected from the group consisting of polycarboxylic acids and polyphosphonic acids. Preferably, the aqueous cleaning composition comprises an acid selected from the group consisting of polycarboxylic acids and polyphosphonic acids, and at least one base selected from the group consisting of alkali metal hydroxides, alkali metal carbonates and alkali metal phosphates.

The acid employed in the aqueous cleaning composition is preferably a chelating polycarboxylic acid such as citric acid or an alkylenepolyamine polyacetic acid, e.g., ethylenediaminetetraacetic acid (EDTA). Most preferably, the acid employed in the aqueous cleaning composition is citric acid. Citric acid is highly effective, non-toxic, inexpensive and not excessively corrosive. It is capable of maintaining a substantially high concentration of iron in solution.

The metal surfaces of equipment such as equipment associated with service water systems tend to become scaled with many types of iron containing deposits, particularly iron oxides such as goethite [FeO(OH)], magnetite [Fe304] and hematite [$Fe_2O_3$]. When citric acid is adjusted to a proper pH, it very effectively dissolves iron containing deposits without adversely affecting the metal surfaces being cleaned.

Bases such as alkali metal hydroxides, alkali metal carbonates and alkali metal phosphates are suitable for the aqueous cleaning composition because they do not contain an amine or ammonia. Alkali metal hydroxides are preferred. Sodium hydroxide is most preferred.

When the base and acid employed in the aqueous cleaning composition are mixed together, one or more salts of the acid ara formed. For example, when sodium hydroxide is admixed with citric acid, sodium citrate is formed. The sodium citrate reacts with the iron to form an iron-citrate complex.

The acid should be employed in the aqueous cleaning composition in an amount sufficient to dissolve substantially all of the iron containing deposits from the metal surfaces being cleaned. The amount of acid required will vary depending upon the nature of the cleaning operation. If the acid employed is citric acid, each pound of iron to be removed will generally require 3.44 pounds of citric acid. One mole of iron is complexed by each mole of citrate.

As used herein and in the appendant claims, the term "pH" refers to the pH value of the aqueous cleaning composition measured at ambient temperature.

The base should be employed in the aqueous cleaning composition in an amount sufficient to make the pH of the composition in the range of from about 2 to about 6. Preferably, the base is employed in the composition in an amount sufficient to make the pH of the composition in the range of from about 3 to about 5, most preferably, in the range of from above 3.5 to below 4.5.

If citric acid is employed in the aqueous cleaning composition, it is important for the base to be employed in an amount sufficient to make the pH of the solution in the range of from about 3.5 to about 4.5. Although the precise pH of a citric acid composition is not critical as long as it is in the range of from about 3.5 to about 4.5, there is evidence that indicates that the maximum iron capacity of such a composition increases as the pH of the composition increases. Accordingly, if citric acid is employed in the composition and the equipment being cleaned is heavily scaled, the pH of the composition should be adjusted to a value on the high side of the 3.5 to 4.5 range. Typically, slower dissolution occurs if the pH of the composition is above 4.5.

If the maximum iron capacity of citric acid is exceeded, precipitation of ferrous citrate may occur. Precipitation of ferrous citrate can be prevented by increasing the initial pH of the aqueous cleaning composition to about 4.5, or by decreasing the citric acid concentration to a value that will result in solvent spending before saturation with ferrous citrate occurs.

Preferably, the aqueous cleaning composition includes a small amount of a corrosion inhibiting compound. Examples of suitable corrosion inhibiting compounds include alkyl pyridines, quaternary amine salts, dibutylthiourea and mixtures thereof. The corrosion inhibiting compound functions to protect the metal surfaces being cleaned from direct attack by the cleaning composition. Preferably, about 0.1 volume percent or more of corrosion inhibitor is included in the composition.

Although the type of water employed in the aqueous cleaning composition is not critical to the practice of the invention, it is desirable in some applications to use potable water or water which has a low dissolved mineral salt content.

In accordance with the method of the present invention, iron containing deposits are removed from a metal surface by contacting the surface with the aqueous cleaning composition described above. The method of the present invention is similar in some respects to the scale removal method disclosed by U.S. Pat. No. 3,072,502, particularly the iron oxide removal steps thereof. U.S. Pat. No. 3,072,502 is incorporated by reference herein.

The metal surfaces of the equipment being cleaned can be contacted with the aqueous cleaning composition in a variety of ways, e.g., by static soaking, pouring, spraying or circulating. Preferably, the aqueous cleaning composition is continuously circulated over the surfaces being cleaned. If continuous circulation is not possible, the composition should be agitated in other ways. Intermittent circulation by drainback and refill is acceptable. The composition can also be agitated by injecting an inert gas therein.

As the metal surfaces being cleaned are contacted with the aqueous cleaning composition, the temperature of the composition is preferably maintained in the range of from about 32° F. to the atmospheric boiling point thereof. More preferably, the temperature of the composition is maintained in the range of from about 130° F. to about 210° F., most preferably in the range of from about 150° F. to about 200° F. If desired, temperatures above the atmospheric boiling point of the composition can be employed by operating under pressure. The rate of iron dissolution is generally higher at greater temperatures.

The metal surfaces are preferably contacted with the aqueous cleaning composition for a period of time sufficient to remove substantially all of the iron containing deposits therefrom. The iron content of the aqueous cleaning composition should be periodically determined to assure that the composition remains active. The iron content of the composition can be determined by any standard procedure. It is important to maintain at least 0.5 percent by weight free acid in the aqueous cleaning composition to keep the composition from becoming spent before the iron containing deposits are removed. If the concentration of free acid in the composition falls below 0.5 percent by weight of the composition, additional acid and base should be added. As used herein and in the appendant claims, "free" acid means acid that is not complexed with iron or any other metals that may be present.

Circulation or some other form of agitation should be continued and the temperature should be maintained in the preferred range until the concentration of iron present in the composition becomes approximately constant with at least 0.5 percent by weight free acid present in the composition. When the concentration of iron present in the composition becomes approximately constant with at least 0.5 percent by weight free acid present in the composition, the metal surfaces being cleaned should be substantially free of iron containing deposits.

After the iron containing deposits are removed, the aqueous cleaning composition can be used to passivate the metal surfaces. The pH of the composition is increased, preferably to a value in the range of from about 8 to about 10. More preferably, the pH of the composition is increased to a value in the range of from about 8.5 to about 9.5, most preferably to about 9. The iron complex held in the composition can break and precipitation can occur if the pH of the composition is increased above 10.

Substantially any alkali metal base can be used to adjust the pH of the composition to the proper level. Alkali metal carbonates and alkali metal phosphates are preferred. Soda ash ($Na_2CO_3$) is the most preferred. Due to its strong basic nature, sodium hydroxide should not be used for this step. The iron complex held in the composition can become unstable and precipitation can occur if sodium hydroxide is used to raise the pH.

After the pH is adjusted to the required level, one or more oxidizing agents are preferably added to the aqueous cleaning composition to create an oxidizing environment conducive to passivation. All types of oxidizing agents can be used. Sodium nitrite ($NaNO_2$) and air are preferred. Preferably, about 0.5 weight percent or more of sodium nitrite is included in the composition. The air is preferably injected into the composition at a rate of 2–20 scfm/1000 gal. If it is not possible to inject air into the composition, the concentration of sodium nitrite in the composition is preferably increased to about 1.0.weight percent or more.

The metal surfaces should be contacted with the aqueous cleaning composition for an amount of time sufficient to assure complete passivation. Once complete passivation has occurred, the aqueous cleaning composition can be disposed.

The composition and method of the present invention will safely and effectively remove high density iron containing deposits from all types of metals, including carbon steels, austenitic stainless steels, copper, brass, bronze and other alloys, without diminishing the integrity thereof. Inasmuch as only one solvent fill is required for iron removal, neutralization and passivation, the time involved and the amount of waste requiring disposal is minimized. It is not necessary to disassemble the equipment being cleaned.

The aqueous cleaning composition contains no ammonia or amines, and has a very low chloride content. As a result, potential failure by stress corrosion cracking of stainless steels, copper, and copper bearing alloys such as brass and bronze is eliminated.

Both citric acid and sodium hydroxide are inexpensive, safe to personnel and easy to obtain. They are effective in relatively low concentrations. Unlike ammonia and some amines, sodium hydroxide does not create annoying and/or dangerous fumes.

In order to illustrate a clear understanding of the composition and method of the present invention, the following examples are given. Although the examples are presented to illustrate certain specific embodiments of the invention, they are not to be construed so as to be restrictive of the scope and spirit thereof.

EXAMPLE I

A sample of a precipitate formed by dissolving iron in an ammoniated citric acid solvent was analyzed for iron, carbon, hydrogen and nitrogen content.

To form the precipitate, 600 milliliters of reagent grade, uninhibited citric acid, ammoniated to a pH of 3.5, and 24 grams of iron powder (less than 100 mesh) were dissolved in a glass container. The container was sealed with a multi-holed rubber stopper, and a rotating stirrer, a thermocouple, an air sparger and various electrodes were immersed in the solution through the stopper.

Nitrogen gas was bubbled into the solution to maintain an inert atmosphere in the container. The solution was heated to 150° F. and continuously stirred. The electrical potential existing between a steel electrode and a standard calomel electrode (SCE) immersed in the solution was continuously monitored.

After a short period of time, a precipitate was formed in the solution. The precipitate was formed due to saturation of the solution with dissolved iron. No inflections were noted in the electrical potential existing between the steel electrode and standard calomel electrode (SCE) as the precipitate was formed.

A sample of the precipitate was taken .from the container and analyzed for iron, carbon, hydrogen and nitrogen content. The analysis was performed with a Carlo Erba model 1106 elemental analyzer manufactured by Carol Erba Instruments, Italy.

The results of the analysis are summarized in TABLE I below.

TABLE I

Analysis of Precipitate Formed by Dissolving Iron in Ammoniated 10% Citric Acid, pH = 3.5

| Element | Content % by Weight |
|---|---|
| Iron (Fe) | 31.7* |
| Carbon (C) | 24.5 |
| Hydrogen (H) | 2.9 |
| Nitrogen (N) | 0.0 |

*Due to a small amount of iron that was inseparable from the precipitate, the weight percent of iron indicated to be present in the precipitate is somewhat inaccurate.

The results of the analysis show that the precipitate formed by dissolving iron in ammoniated 10% citric acid does not contain any nitrogen. The complex formed by the dissolution of iron in ammoniated citric acid is ferrous citrate, not ferrous ammonium citrate. The complex is believed to be a hydrated ferrous citrate having the approximate formula $FeC_6H_6O_7.H_2O$.

EXAMPIE II

A sodium citrate solvent was used to remove iron containing deposits from a chilled water system constructed of dissimilar metals. The system consisted of approximately 1000 feet of eight inch pipe and had a volume of over 2600 gallons.

The solvent was prepared by admixing approximately 1300 pounds of dry citric acid with approximately 528 pounds of flaked 50% caustic (NaOH) and 26 gallons of a corrosion inhibitor (OSI-1). "OSI-1" is the tradename of a corrosion inhibitor that is commercially available from Halliburton Company of Dallas, Tex.

The interior metal surfaces of the chilled water system were contacted with the solvent by continuously circulating the solvent through the confines of the piping system. As the method was carried out, the temperature of the solvent was maintained in the range of from about 130° F. to about 150° F. by continuously injecting steam into the solvent. The solvent was agitated by the continuous recirculation.

The concentration of iron and free citric acid present in the solvent and the pH of the solvent were periodically determined as the method was carried out. At least 0.5 percent by weight free citric acid was maintained in the solvent at all times. The concentration of iron was determined by elemental analysis. The concentration of free citric acid was determined by material balance methods. The pH of the solvent was determined by use of a standard laboratory pH meter.

The method was continued until the concentration of iron present in the solvent became approximately constant. A summary of some of the data collected is presented in TABLE II below.

After the method was completed, a sample of the solvent was collected and analyzed. The concentration of total citric acid present in the sample was determined by total organic carbon analysis (TOC) to be 3.9 percent by weight of the sample. The concentration of free citric acid present in the sample was determined by material balance methods to be 1.5 percent by weight of the sample. The concentration of free citric acid present in the sample was verified by titrimetric procedures. The sample was then analyzed by adsorption spectroscopy (AA) and X-ray fluorescence spectroscopy (XRF) to determine the content of dissolved metals therein. The results of this determination are summarized in TABLE III below.

TABLE II

Field Analysis of Iron Content and pH of Solvent

| Contact Time (Hours) | Concentration of Iron (Fe) | pH |
|---|---|---|
| 1.3 | ↓ | 4.40 |
| 2.3 | ↓ | 4.65 |
| 3.8 | ↓ | 4.70 |
| 5.3 | Increasing | 4.75 |
| 6.3 | ↓ | 4.80 |
| 7.3 | ↓ | 4.85 |
| 8.3 | ↓ | 4.85 |
| 9.3 | ↓ | 4.85 |
| 10.3 | ↓ | 4.90 |
| 11.3 | ↓ | 4.90 |
| 12.3 | Stable | 5.00 |
| 13.3 | ↓ | 5.00 |
| 14.3 | ↓ | 5.00 |
| 15.3 | ↓ | 5.00 |
| 16.3 | ↓ | 5.00 |

TABLE III

Laboratory Analysis of Metal Content of Solvent

| Component | Concentration of Component (%)* | Approximate Formula of Component | Quantity of Component Removed** (Pounds) |
|---|---|---|---|
| Iron (Fe) | 0.634 | FeO(OH) | 218 |
| Copper (CU) | 0.032 | CU | 7 |
| Nickel (Ni) | 0.003 | NiO | <1 |
| Zinc (Zn) | 0.004 | ZnO | <1 |
| Calcium (Ca) | 0.003 | $CaCO_3$ | 16 |

*percent by weight of the sample.
**based on 2600 gallon volume.

As shown by TABLES II and III, the amount of iron present in the sodium citrate solvent appeared to become constant after about 12 hours. Although the solvent had dissolved a significant amount of iron at this point, it is believed that more iron could have been dissolved by carrying out the method for a longer period of time. The continuous injection of steam most likely diluted the solvent and caused the concentration of iron present in the solvent to appear to be approximately constant after 12 hours of contact time when in fact it was not.

Nevertheless, the results show that effective iron dissolution can be achieved by a sodium citrate solvent. Aqueous cleaning compositions comprising an alkali metal salt of citric acid can be used to effectively clean equipment constructed of dissimilar metals.

EXAMPLE III

A laboratory test was conducted to confirm the effectiveness of sodium citrate in dissolving iron containing deposits from a metal surface. An aqueous sodium citrate cleaning composition was used to remove iron containing deposits from a section of pipe removed from the chilled water system described in Example II above.

The cleaning composition was prepared by placing 0.1 percent by volume corrosion inhibitor (OSI-1), 6 percent by weight citric acid and an amount of caustic (NaOH) sufficient to make the pH of the composition approximately 4.5 in a container and thoroughly mixing the same. The composition was then placed on the section of pipe.

The surface area of the chilled water system from which the section of pipe was removed was approximately 2090 feet. Approximately 2600 gallons of solvent were used to clean the system. In order to approximate the ratio of the volume of solvent used to clean the system and the surface area of the system in this experiment, the composition was placed on the section of pipe such that the ratio of the composition volume to the surface area of the pipe was 32.7 milliliters per square inch. The surface area of the pipe was 5.01 square inches, and the volume of the solvent placed thereon was 164 milliliters.

The experiment was conducted at a temperature of 155° F. The solvent was swirled approximately once an hour. The concentrations of iron and free citric acid present in the solvent were periodically determined throughout the contact period.

The results of the experiment are summarized in TABLE IV below.

TABLE IV

| Analysis of Iron and Free Citric Acid Content of Composition | | |
|---|---|---|
| Contact Time (Hours) | Concentration of Iron (%)* | Concentration of Free Citric Acid (%)** |
| 2 | 0.66 | 3.73 |
| 3 | 0.94 | 2.77 |
| 5 | 1.05 | 2.39 |
| 7 | 1.21 | 1.84 |
| 8 | 1.28 | 1.60 |

*Percent by weight of solvent.
**Percent by weight of solvent.

The results of the experiment show that an aqueous sodium citrate cleaning composition will aggressively dissolve iron containing deposits, even under quasi-static conditions. The rate of iron dissolution decreased slightly as the concentration of free citric acid present in the solvent decreased.

EXAMPLE IV

Tests were conducted to determine the effectiveness of sodium citrate and ammonium citrate as solvents for cleaning and passivating metal surfaces. The effectiveness of the solvents were compared.

A first series of tests was conducted to determine the effectiveness of sodium citrate at various pH levels. In each test, 100 milliliters of a solution containing deionized water, 10% by weight citric acid, an amount of sodium hydroxide (NaOH) sufficient to raise the pH of the solution to the desired level, and 0.1% by volume corrosion inhibitor (OSI-1) were thoroughly mixed together and placed in a container.

A sample of service water system scale consisting of 2.0 grams of iron containing deposits (primarily goethite and a small to moderate amount of magnetite) and one mild steel coupon were placed in the container. The container was then sealed and placed in a thermostated water bath. The temperature of the solution was maintained at approximately 150° F. throughout the test period. The solution was swirled approximately once each hour. Samples of the solution were periodically taken from the container and analyzed for dissolved iron content using colorimetric procedures.

After the last sample was analyzed for dissolved iron content, 10 grams of sodium carbonate ($Na_2CO_3$) were added to the solution to substantially raise the pH thereof. Thereafter, 0.5 grams of sodium nitrite ($NaNO_2$) were added to the solution and air was injected into the solution for 45 minutes. After the injection of air was terminated, the final pH of the solution was determined by measuring the pH of a sample of the solution that has been allowed to cool to ambient temperature.

The results of the first series of tests are summarized in TABLE V below.

Next, a second series of tests was conducted to compare the effectiveness of sodium citrate and ammonium citrate in cleaning and passivating metal surfaces at various pH levels. In each test, 100 milliliters of a solution containing deionized water, 10% by weight citric acid, an amount of either sodium hydroxide (NaOH) or ammonium hydroxide ($NH_4OH$) sufficient to raise the pH of the solution to the desired level, and 0.1 percent by volume corrosion inhibitor (OSI-1) were thoroughly mixed together and placed in a container.

A sample of service water system scale consisting of 3.0 grams of iron containing deposits (primarily goethite and a small to moderate amount of magnetite) and one mild steel coupon were placed in the container. The container was then sealed and placed in a thermostated water bath. The temperature of the solution was maintained at approximately 150° F. throughout the test period. The solution was swirled approximately once each hour. Samples of the solution were periodically taken from the container and analyzed for dissolved iron content using colorimetric procedures.

After the last sample was analyzed for dissolved iron content, 10 grams of sodium carbonate ($Na_2CO_3$) were added to the solution to substantially raise the pH thereof. Thereafter, 0.5 grams of sodium nitrite (NaN02) were added to the solution, and air was injected into the solution for 45 minutes. After the injection of air into the solution was terminated, the final pH of the solution was determined by measuring the pH of a sample of the solution that had been allowed to cool to ambient temperature.

The results of the second series of tests are summarized in TABLE VI below.

TABLE V

| Analysis of pH and Iron Content of Sodium Citrate Solution | | | | |
|---|---|---|---|---|
| | Concentration of Iron (%)* | | | |
| Initial pH of Solution | After 2 Hrs. | After 4 Hrs. | After 6 Hrs. | Final pH of Solution |
| 3.0 | 0.34 | 0.73 | 1.02 | —** |
| 3.5 | 0.70 | 1.21 | 1.49 | 3.9 |
| 4.0 | 0.64 | 1.17 | 1.44 | 4.4 |
| 4.5 | 0.55 | 1.02 | 1.28 | 5.0 |
| 5.0 | 0.35 | 0.67 | 0.86 | 5.5 |

*Percent by weight of the solution.
**This test was aborted before the final pH could be determined. The test was aborted because the solution foamed over the confines of the container when the sodium carbonate ($Na_2CO_3$) was added. All of the other tests were completed with no evidence of undesirable solvent behavior.

TABLE VI

| Analysis of pH and Iron Content of Sodium Citrate and Ammonium Citrate Solutions | | | | | | |
|---|---|---|---|---|---|---|
| | | Concentration of Iron (%)* | | | | |
| Base Employed | Initial pH of Solution | After 2 Hrs. | After 4 Hrs. | After 6 Hrs. | After 8 Hrs. | Final pH of Solution** |
| NaOH | 3.5 | 0.44 | 0.59 | 1.42 | 1.63 | 3.8 |

TABLE VI-continued

| Base Employed | Initial pH of Solution | Analysis of pH and Iron Content of Sodium Citrate and Ammonium Citrate Solutions: Concentration of Iron (%)* After 2 Hrs. | After 4 Hrs. | After 6 Hrs. | After 8 Hrs. | Final pH of Solution** |
|---|---|---|---|---|---|---|
| $NH_4OH$ | 3.5 | 0.39 | 0.67 | 1.48 | 1.70 | 3.8 |
| NaOH | 4.0 | 0.44 | 0.71 | 1.24 | 1.57 | 4.5 |
| $NH_4OH$ | 4.0 | 0.47 | 0.70 | 1.42 | 1.67 | 4.4 |
| NaOH | 4.5 | 0.32 | 0.48 | 0.98 | 1.19 | 5.2 |
| $NH_4OH$ | 4.5 | 0.42 | 0.90 | 1.33 | 1.48 | 5.2 |
| NaOH | 5.0 | 0.13 | 0.34 | 0.61 | 0.70 | 5.6 |
| $NH_4OH$ | 5.0 | 0.25 | 0.62 | 0.85 | 1.04 | 5.8 |

*Percent by weight of solution.
**Average value of duplicate tests.

As shown by TABLE V, sodium citrate is very aggressive toward iron containing deposits at all the pH levels tested. The rate of iron dissolution decreased significantly when the initial pH of the solution was below 3.5 or above 4.5.

As shown by TABLE VI, sodium citrate performs essentially the same as ammonium citrate in removing iron containing deposits of the type commonly encountered in service water systems. Both compositions became significantly less aggressive toward the deposits at a pH above 4.5.

The preceding examples can be repeated with similar success by substituting the generically or specifically described reactants and/or operating conditions of this invention for those used in the examples.

Although certain preferred embodiments of the invention have been described for illustrative purposes, it will be appreciated that various modifications and innovations of the composition and method recited herein may be effected without departure from the basic principles which underlie the invention. Changes of this type are therefore deemed to lie within the spirit and scope of the invention except as may be necessarily limited by the amended claims or reasonable equivalents thereof.

What is claimed is:

1. A method of cleaning and passivating at least one metal surface of equipment constructed of dissimilar metals, including at least one copper-containing metal and one ferrous-containing metal comprising:

contacting said surface with an aqueous cleaning composition that is free of ammonia and amines under conditions and for a period of time sufficient to remove iron containing deposits therefrom, without detrimentally effecting the dissimilar metals, said aqueous cleaning composition consisting of an alkali metal salt of citric acid formed by admixing citric acid with at least one base selected from the group consisting of alkali metal hydroxides, alkali metal carbonates and alkali metal phosphates, said base being admixed with said citric acid in an amount sufficient to make the pH of said composition in the range of from about 3.5 to about 4.5, and a corrosion inhibiting compound; and after iron containing deposits are removed from said surface, adjusting the pH of said aqueous cleaning composition to a value in the range of from about 8 to about 10 and adding at least one oxidizing agent to said composition to passivate said metal surface.

2. The method of claim 11 wherein said base is sodium hydroxide.

3. The method of claim 1 wherein prior to the steps of adjusting the pH of said aqueous cleaning composition to a value in the range of from about 8 to about 10 and adding at least one oxidizing agent to said composition to passivate said metal surface, said method further comprises the steps of:

maintaining at least 0.5 percent by weight free citric acid in said aqueous cleaning composition until the concentration of iron present in said composition becomes approximately constant; and maintaining the temperature of said aqueous cleaning composition in the range of from about 150° F. to about 200° F. until the concentration of iron present in said composition becomes approximately constant.

4. The method of claim 1 wherein after iron containing deposits are removed from said surface, said pH of said aqueous cleaning composition is adjusted to a value in the range of from about 8.5 to about 9.5 by addition of a sufficient quantity of a base selected from the group consisting of alkali metal carbonates and alkali metal phosphates without precipitation of iron from the composition.

5. The method of claim 1, wherein said pH of said aqueous cleaning composition is adjusted to a value in the range of from about 8 to about 10 by adding soda ash thereto.

6. The method of claim 5 wherein said oxidizing agent added to said aqueous cleaning composition is sodium nitrite.

7. The method of claim 6 wherein both sodium nitrite and air are added as oxidizing agents to said aqueous cleaning composition.

* * * * *